US006375337B1

(12) United States Patent
Hwang

(10) Patent No.: US 6,375,337 B1
(45) Date of Patent: Apr. 23, 2002

(54) ORNAMENTAL DISPLAY LAMP ASSEMBLY

(75) Inventor: Yng-Tsuen Hwang, Hsinchu (TW)

(73) Assignee: Ching-Chao Chen, Hsinchu City (TW)

( * ) Notice: Subject to any disclaimer, the term of this patent is extended or adjusted under 35 U.S.C. 154(b) by 0 days.

(21) Appl. No.: 09/685,889

(22) Filed: Oct. 11, 2000

(51) Int. Cl.[7] ..... F21V 33/00

(52) U.S. Cl. ..... 362/101; 362/226; 362/253; 362/439

(58) Field of Search ..... 362/226, 439, 362/360, 310, 363, 101, 318, 253, 806, 811; 313/110, 111

(56) References Cited

U.S. PATENT DOCUMENTS 2,520,691 A * 8/1950 Otis
3,780,260 A * 12/1973 Elsner ..... 219/271
4,072,855 A * 2/1978 Marchese ..... 362/101
4,170,035 A * 10/1979 Walker ..... 362/31
5,105,343 A * 4/1992 Wakimoto ..... 362/101
5,683,254 A * 11/1997 Lin ..... 439/11
5,803,580 A * 9/1998 Tseng ..... 362/96
5,860,732 A * 1/1999 Coleman et al. ..... 362/253
6,309,084 B1 * 10/2001 Lin ..... 362/101

* cited by examiner

*Primary Examiner*—Sandra O'Shea
*Assistant Examiner*—Jacob Y. Choi
(74) *Attorney, Agent, or Firm*—Varndell & Varndell, PLLC

(57) ABSTRACT

An ornamental display lamp assembly includes a combination lamp socket and plug device holding a lamp bulb and a lampshade around the lamp bulb, and a decorative glass tube supported on the lampshade and disposed in contact with the lamp bulb to receive heat and light from the lamp bulb, the decorative glass tube containing a deposit accumulated on the inside, a volume of water floated on the deposit, and a volume of dichloromethane ($CH_2Cl_2$), the deposit being composed of solid state sodium silicate ($NaSiO_3$) and rocks embedded in the solid state sodium silicate, the contained dichloromethane being maintained between the deposit and the layer of water when the lamp bulb is off and the decorative glass tube receives no heat from said lamp bulb, the contained dichloromethane being changed into bubbles when heated by heat from the lamp bulb during the operation of the lamp bulb, which bubbles float upwards from the bottom side of the layer of water to its top side and then sink when reached the top side of the layer of water.

3 Claims, 6 Drawing Sheets

ORNAMENTAL DISPLAY LAMP ASSEMBLY

BACKGROUND AND SUMMARY OF THE INVENTION

The present invention relates to an ornamental display lamp assembly and, more particularly to such an ornamental display lamp assembly, which causes dichloromethane to change into bubbles to float up and down in a layer of water in an ornamental glass tube when its lamp bulb is turned on to emit light.

FIGS. 1 and 2 show a commercially available ornamental display lamp assembly 9. This structure of ornamental display lamp assembly 9 comprises a combination lamp socket and plug device 91, a lamp bulb 911 installed in the socket unit of the combination lamp socket and plug device 91, a lampshade 92 formed of a bottom shell 922 and a top cover shell 921 and mounted on the combination lamp socket and plug device 91 around the lamp bulb 911, and a decorative glass tube 93 supported on the lampshade 92 and disposed in contact with the glass bulb of the lamp bulb 911 to receive heat and light from the lamp bulb 911. The decorative glass tube 93 is filled with sodium silicate ($NaSiO_3$) and silica ($SiO_2$), and then heated to about 30°~35° C., and then cooled down, causing a deposit 931 accumulated in the bottom side. After formation of the deposit 931 in the decorative glass tube 93, a volume of dichloromethane ($CH_2Cl_2$) 90 is filled in the decorative glass tube 93, and then the open topside of the decorative glass tube 93 is sealed after exhaust of gas. When turning on the lamp bulb 911, heat is transmitted from the lamp bulb 911 through the deposit 931 in the decorative glass tube 93 to dichloromethane ($CH_2Cl_2$) 90 to change into bubbles 900 (see FIG. 3), and at the same time light from the lamp bulb 911 is refracted through boiling dichloromethane in different directions. This structure of ornamental display lamp assembly is less attractive. Further, it uses much volume of dichloromethane.

According to one aspect of the present invention, the ornamental display lamp assembly comprises a combination lamp socket and plug device holding a lamp bulb and a lampshade around the lamp bulb, and a decorative glass tube supported on the lampshade and disposed in contact with the lamp bulb to receive heat and light from the lamp bulb. The decorative glass tube contains a deposit accumulated on the inside, a volume of water floated on the deposit, and a volume of dichloromethane ($CH_2Cl_2$) The deposit is composed of solid-state sodium silicate ($NaSiO_3$), and rocks embedded in the solid-state sodium silicate. The contained dichloromethane is maintained between the deposit and the layer of water when the lamp bulb is off and the decorative glass tube receives no heat from said lamp bulb. The contained dichloromethane is changed into bubbles when heated by heat from the lamp bulb during the operation of the lamp bulb, and the bubbles float upwards from the bottom side of the layer of water to its topside and then sink when reached the topside of the layer of water. Because a volume of water is contained in the decorative glass tube, less amount of dichloromethane is used.

DETAILED DESCRIPTION OF THE PREFERRED EMBODIMENT

Figure 1:
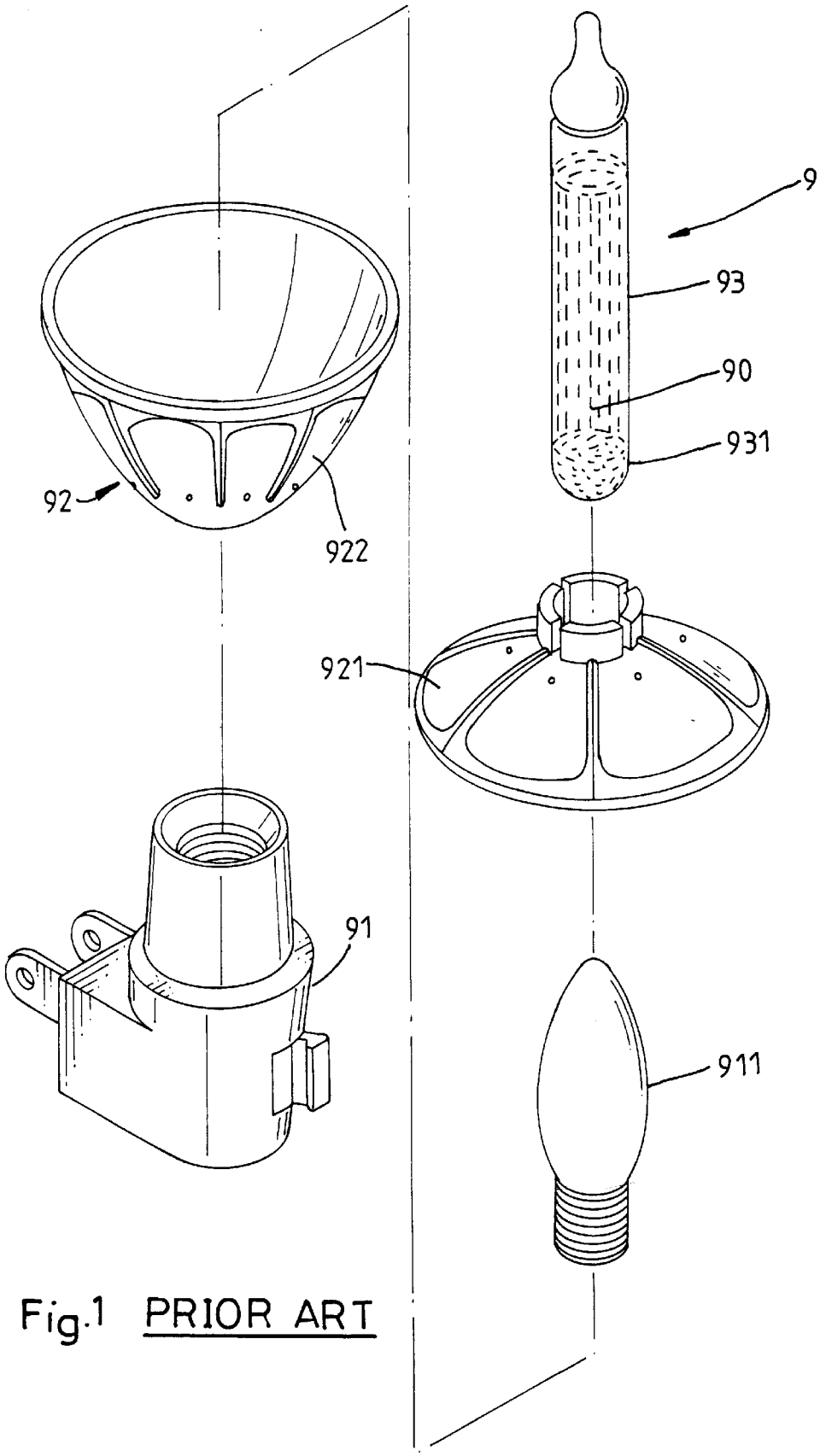
Fig.1 PRIOR ART
FIG. 1 is an exploded view of an ornamental display lamp assembly according to the prior art.
Figure 2:
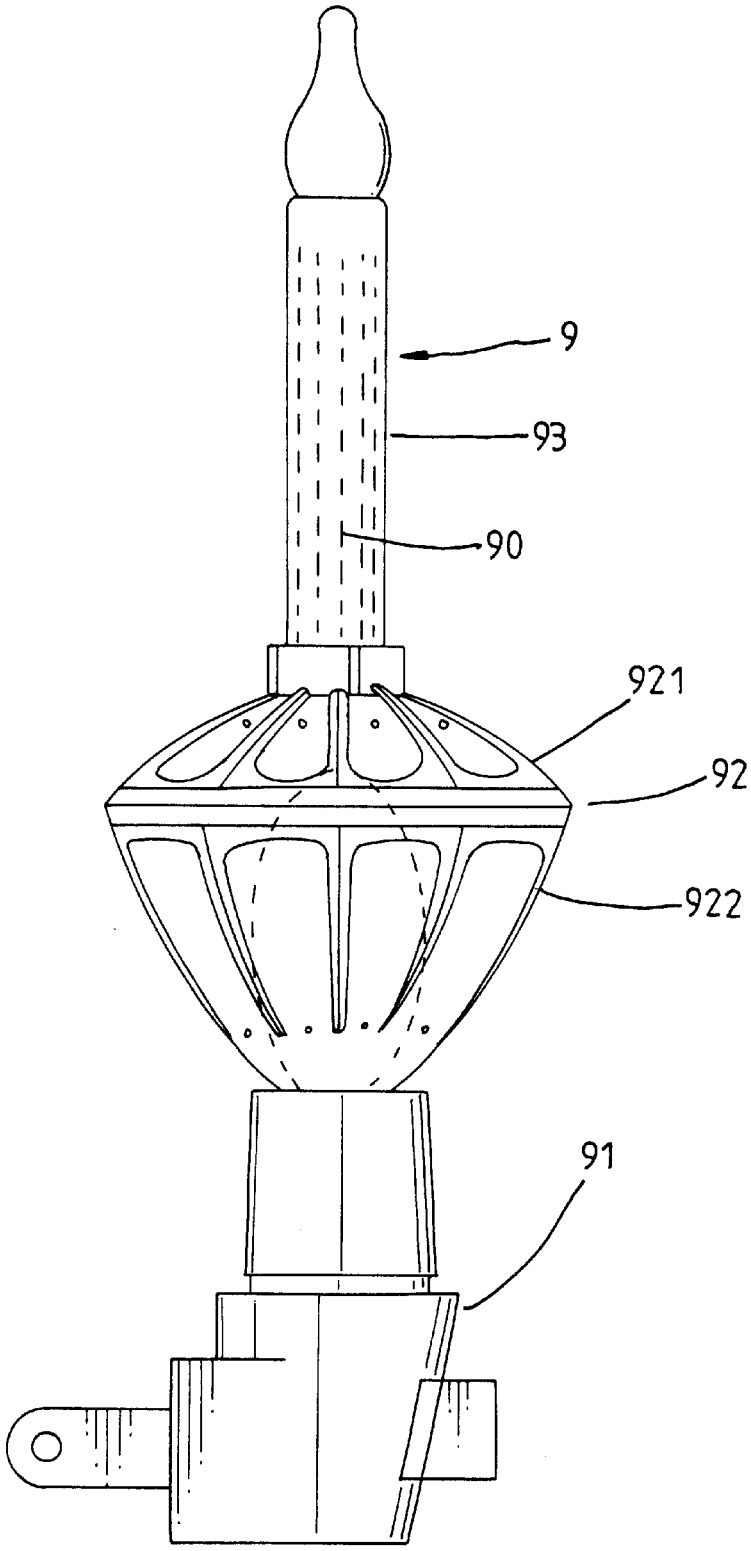
Fig. 2 PRIOR ART
FIG. 2 is a plain view of the ornamental display lamp assembly shown in FIG. 1.
Figure 3:
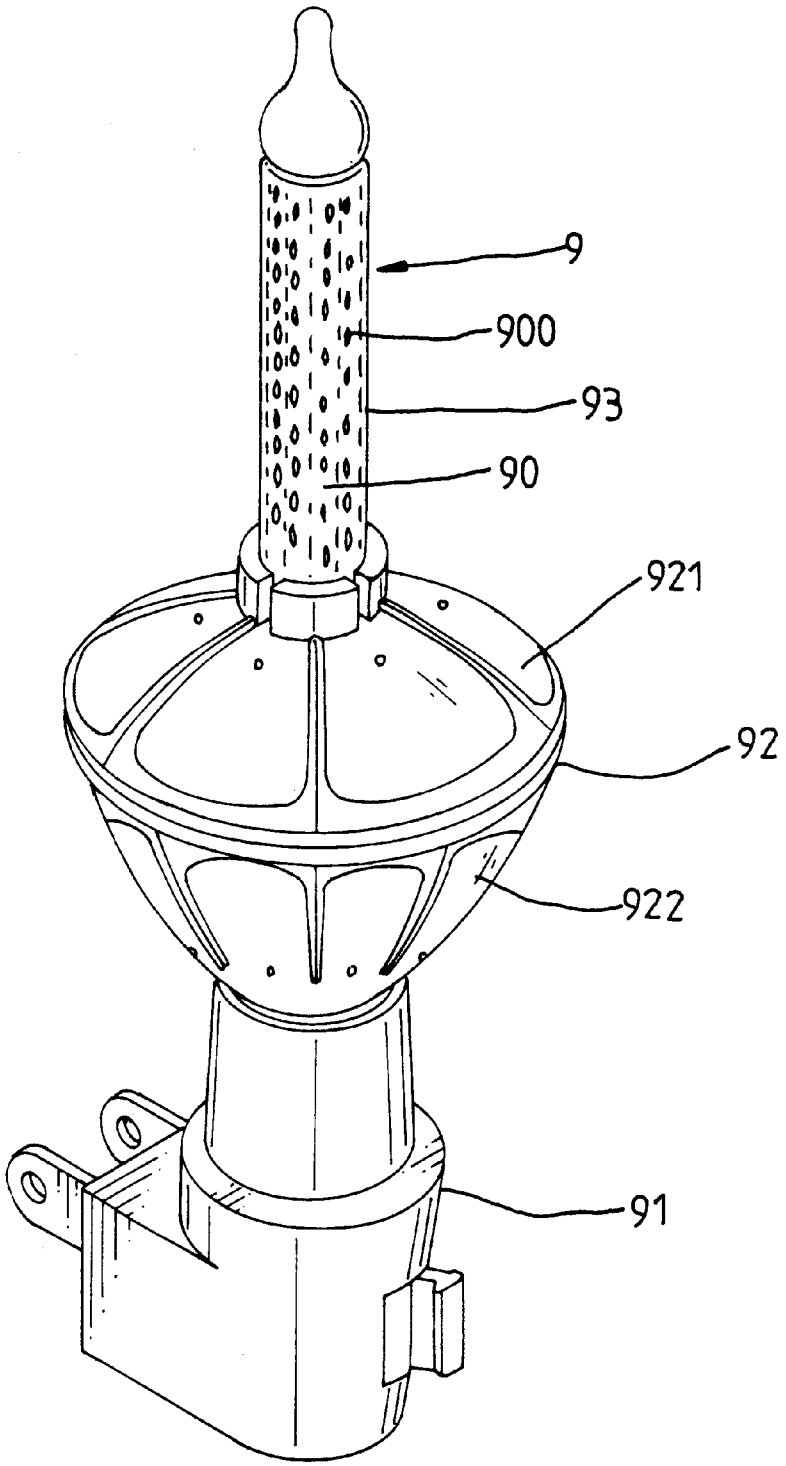
Fig. 3 PRIOR ART
FIG. 3 illustrates an operation status of the prior art ornamental display lamp assembly.
Figure 4:
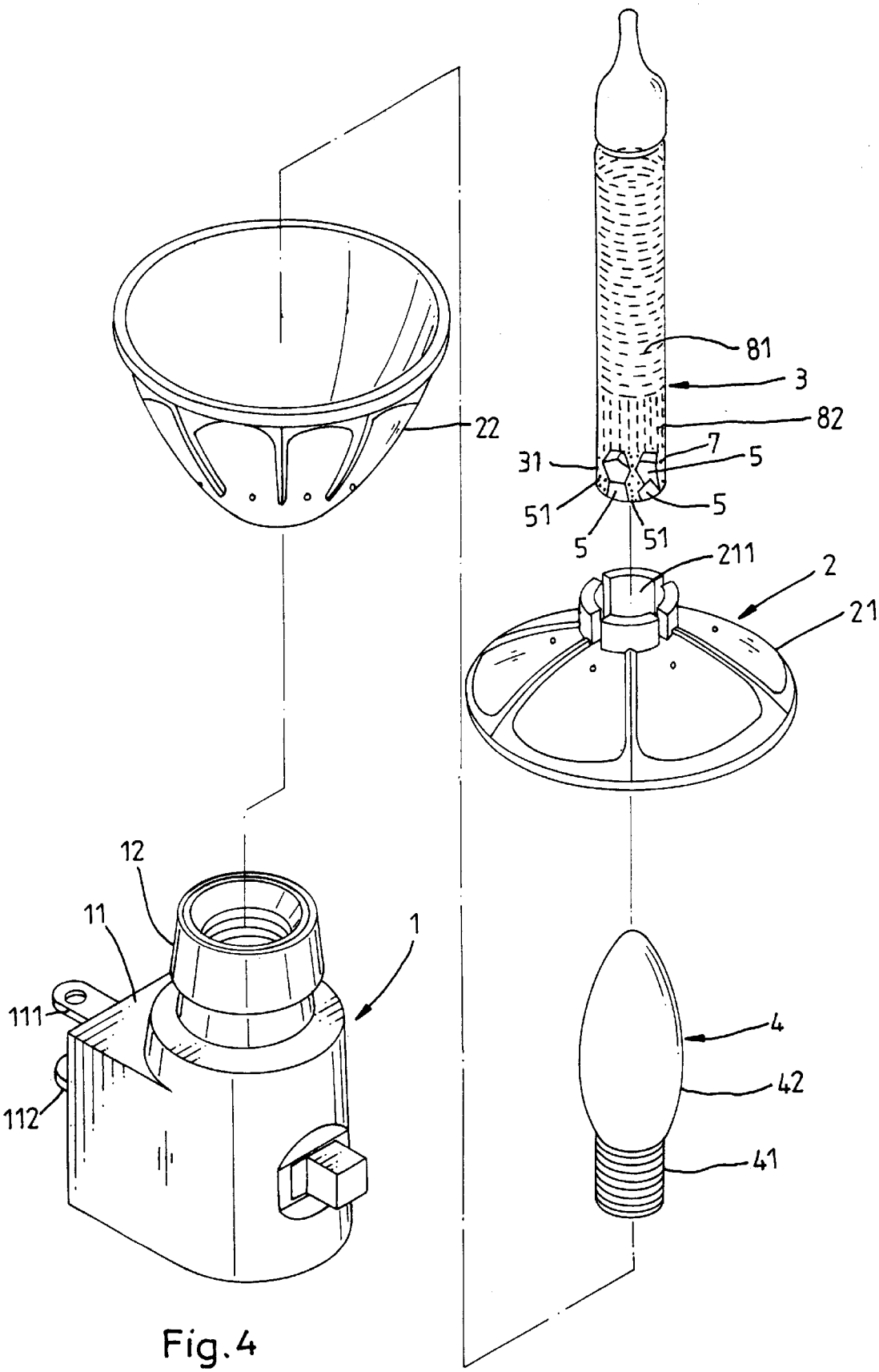
FIG. 4 is an exploded view of an ornamental display lamp assembly according to the present invention.
Figure 5:
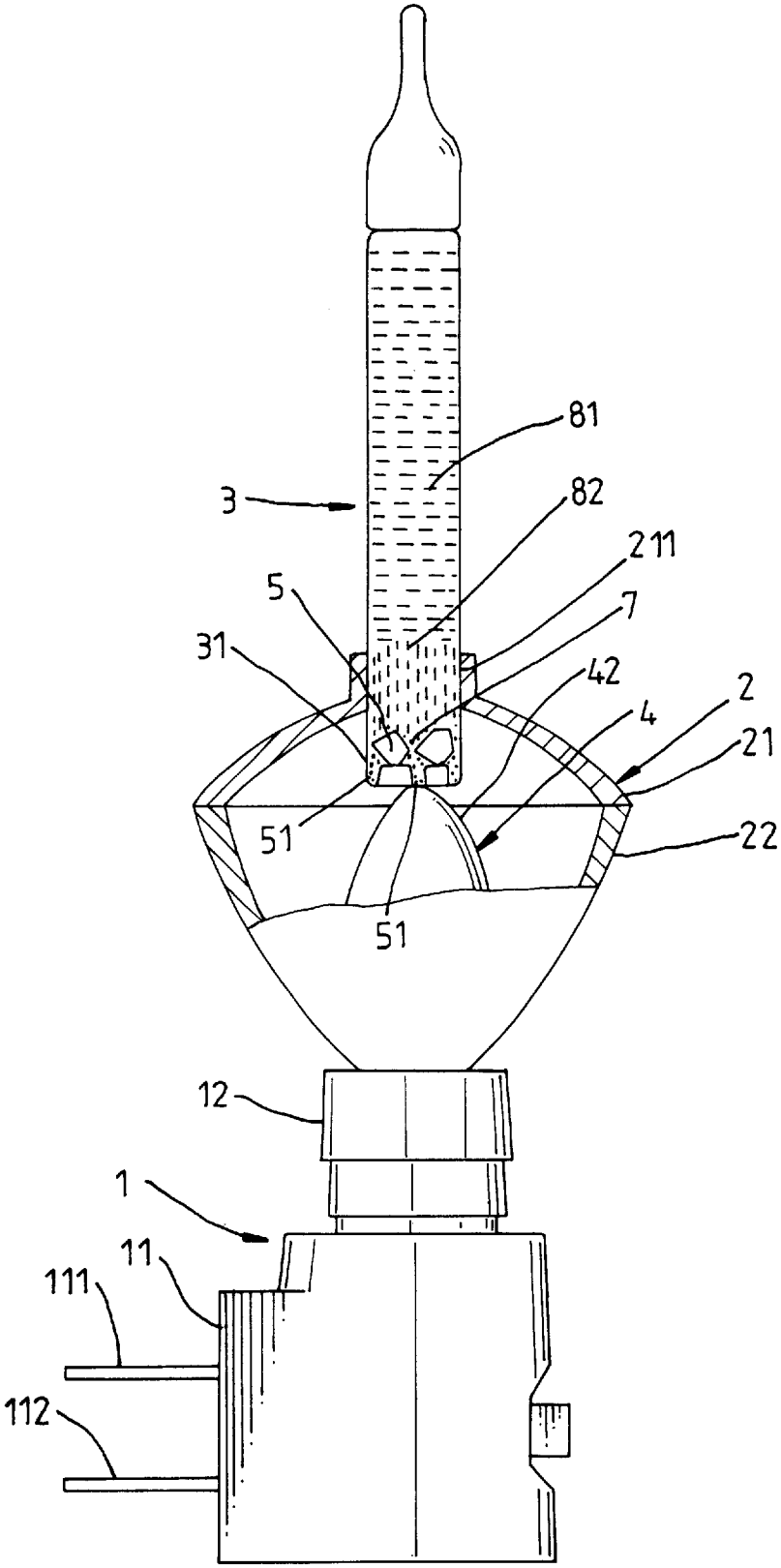
FIG. 5 is a plain view of the ornamental display lamp assembly shown in FIG. 4.
Figure 6:
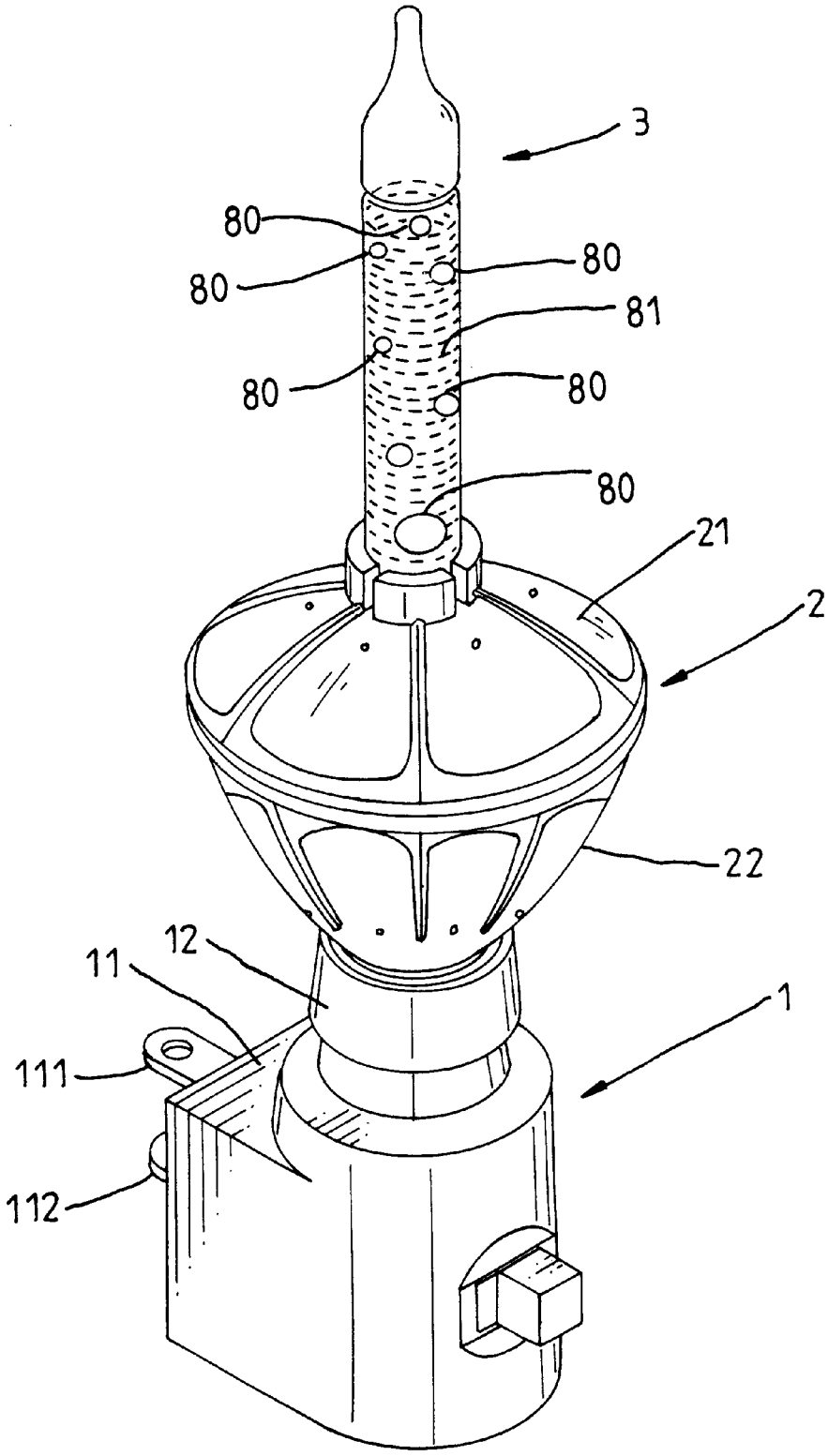
FIG. 6 illustrates an operation status of the ornamental display lamp assembly according to the present invention.

Referring to FIGS. from 4 through 6, an ornamental display lamp assembly in accordance with the present invention is generally comprised of a combination lamp socket and plug device 1, a lampshade 2, a decorative tube 3, and a lamp bulb 4. The combination lamp socket and plug device 1 comprises an electric plug unit 11 horizontally disposed at the bottom side thereof and an electric socket unit 12 vertically disposed at the topside thereof. The plug unit 11 has two metal blades 111 and 112 adapted for connection to an electric outlet to obtain power supply. The socket unit 12 receives the lamp bulb 4. The lampshade 2 comprises a hollow, rounded, bowl-like bottom shell 22 fastened to the Rocket unit 12, and a top cover shell 21 covered on the bottom shell 22. The top cover shell 21 comprises a center mounting through hole 211. The lamp bulb 4 is suspended in the lampshade 2 with its base 41 extended out of the bottom center through hole (not shown) of the bottom shell 22 and threaded into the socket unit 12. The decorative tube 3 is an enclosed glass tube mounted in the center mounting through hole 211 of the top cover shell 21 and disposed in contact with the glass bulb 42 of the lamp bulb 4. When the lamp bulb 4 is on, heat is transmitted from the glass bulb 42 of the lamp bulb 4 to the decorative tube 3.

Referring to FIGS. from 4 through 6 again, tiny rocks 5 are put in the decorative tube 3, and then sodium silicate ($NaSiO_3$) 7 is added to the rocks 5 in the decorative tube 3, and then the decorative tube 3 is heated to about 220°~250° C. and then cooled down, causing sodium silicate 7 to be hardened, and therefore the rocks 5 are embedded in hardened sodium silicate 7, forming a deposit 31 in the decorative tube 3. In the deposit 31, gaps 51 of different sizes exist between the rocks 5. After formation of the deposit 31, water 81 and dichloromethane ($CH_2Cl_2$) 82 are added to the deposit 31 in the decorative tube 3 at the ratio of 4:1 by volume, and then the top open end of the decorative tube 3 is sealed after exhaust of gas from the decorative tube 3.

Because dichloromethane ($CH_2Cl_2$) 82 is not soluble in water and has a specific gravity greater than waters dichloromethane 92 is maintained in the decorative tube 3 between the deposit 31 and the layer of water 81 when the lamp bulb 4 is off. After the lamp bulb 4 had been turned on, heat is transmitted from the glass bulb 42 of the lamp bulb 4 through the decorative tube 3 and the gaps 51 to dichloromethane 82. Because the boiling point of dichloromethane 82 is low, dichloromethane 82 is quickly boiled into bubbles 80 of low specific gravity, and bubbles 80 of dichloromethane 82 thus formed quickly float upwards to the top side of the layer of water 81. Due to relatively lower temperature at the topside of the layer of water 81, bubbles 80 of dichloromethane 82 sink quickly when reached the topside of the layer of water 81. Therefore, different sizes of bubbles 80 are irregularly produced to float up and down in the layer of water 81 in the decorative tube 3 when the lamp bulb 4 is on, and at the same time the light of the lamp bulb 4 is refracted in the deposit 31 and the layer of water 81.

Further, before adding dichloromethane 82 to the deposit 31 in the decorative tube 3, oil color substance can be mixed with dichloromethane 82 to provide the desired color.

What is claimed is:

1. An ornamental display lamp assembly comprising:

a combination lamp socket and plug device, said combination lamp socket and plug device comprising an electric plug unit horizontally disposed at a bottom side thereof, and an electric socket unit vertically disposed at a top side thereof;

a lampshade fastened to said electric socket unit of said combination lamp socket and plug device, said lampshade comprising a hollow bottom shell fastened to said electric socket unit, and a top cover shell covered on said bottom shell, said top cover shell having a center mounting through hole;

a lamp bulb installed in said electric socket unit of said combination lamp socket and plug device and suspended inside said lampshade; and a decorative glass tube mounted in the center mounting through hole of said top cover shell of said lampshade, said decorative glass tube having a topside extended out of said lampshade and a bottom side disposed in contact with the said lamp bulb to receive heat and light from said lamp bulb;

wherein said decorative glass tube contains a deposit accumulated on the inside, a volume of water floated on said deposit, and a volume of dichloromethane ($CH_2Cl_2$), said deposit being composed of solid state sodium silicate ($NaSiO_3$) and rocks embedded in said sodium silicate, the ratio between said dichloromethane and said layer of water being at 1:4 by volume, said dichloromethane being maintained between said deposit and said layer of water when said lamp bulb is off and said decorative glass tube receives no heat from said lamp bulb, said dichloromethane being changed into bubbles, that float upwards from a bottom side of said layer of water to a top side thereof and then sink when reached the top side of said layer of water, when heated by heat from said lamp bulb during the operation of said lamp bulb.

2. The ornamental display lamp assembly of claim 1 wherein said solid state sodium silicate ($NaSiO_3$) is obtained from liquid state sodium silicate through a 220°~250° heating procedure and then a cooling procedure.

3. The ornamental display lamp assembly of claim 1 wherein said dichloromethane is mixed with a coloring substance of a predetermined color.

* * * * *